US008978539B2

(12) United States Patent
Teetzel et al.

(10) Patent No.: US 8,978,539 B2
(45) Date of Patent: Mar. 17, 2015

(54) WEAPON VIDEO DISPLAY SYSTEM EMPLOYING SMARTPHONE OR OTHER PORTABLE COMPUTING DEVICE

(71) Applicant: Wilcox Industries Corp., Newington, NH (US)

(72) Inventors: James W. Teetzel, York, ME (US); Dominic R. Goupil, Kittery, ME (US); Marc J. Celona, Dover, NH (US); Justin D. Harris, Haverhill, MA (US)

(73) Assignee: Wilcox Industries Corp., Newington, NH (US)

( * ) Notice: Subject to any disclaimer, the term of this patent is extended or adjusted under 35 U.S.C. 154(b) by 78 days.

(21) Appl. No.: 13/762,741

(22) Filed: Feb. 8, 2013

(65) Prior Publication Data

US 2015/0041538 A1 Feb. 12, 2015

Related U.S. Application Data

(60) Provisional application No. 61/597,025, filed on Feb. 9, 2012.

(51) Int. Cl.

| | |
|---|---|
| ***F41G 5/06*** | (2006.01) |
| ***F41G 3/16*** | (2006.01) |
| ***F41G 1/473*** | (2006.01) |

(52) U.S. Cl.

CPC ..... *F41G 3/165* (2013.01); *F41G 1/473* (2013.01)

USPC ..... 89/41.05; 89/41.17; 42/111; 42/115; 42/119; 42/131

(58) Field of Classification Search

CPC ..... F41G 3/165; F41G 3/06; F41G 1/473

USPC ..... 89/41.17, 41.05; 42/111, 115, 119, 131

See application file for complete search history.

(56) References Cited

U.S. PATENT DOCUMENTS

| | | | | |
|---|---|---|---|---|
| 4,671,165 | A * | 6/1987 | Heidmann et al. | 89/41.19 |
| 5,347,910 | A * | 9/1994 | Avila et al. | 89/41.22 |
| 5,579,165 | A * | 11/1996 | Michel et al. | 359/630 |
| 6,237,462 | B1 * | 5/2001 | Hawkes et al. | 89/41.05 |
| 6,269,730 | B1 * | 8/2001 | Hawkes et al. | 89/41.05 |
| 6,499,382 | B1 * | 12/2002 | Lougheed et al. | 89/41.05 |
| 6,516,699 | B2 * | 2/2003 | Sammut et al. | 89/41.17 |
| 6,679,158 | B1 * | 1/2004 | Hawkes et al. | 89/41.05 |
| 6,973,865 | B1 * | 12/2005 | Duselis et al. | 89/41.05 |
| 7,255,035 | B2 * | 8/2007 | Mowers | 89/41.05 |

(Continued)

*Primary Examiner* — Samir Abdosh

(74) *Attorney, Agent, or Firm* — McLane, Graf, Raulerson & Middleton, Professional Association

(57) ABSTRACT

A video display system for a weapon includes a removably attachable optical range finder for calculating a distance to a selected target. The optical range finder includes an optical emitter for sending an optical signal to a target and an optical detector for detecting the signal reflected from the target. A fire control system is removably attachable to the weapon and associated with the optical range finder. The fire control system includes a ballistics computer for calculating a ballistics solution based on the distance to the target. A portable electronic device associated with the fire control system has a display screen and is removably attachable to the weapon. The portable electronic device includes a processor and a memory storing program instructions, the program instructions configured to display the ballistics solution in human viewable form on the display screen. In another aspect, a weapon video display housing configuration is provided.

20 Claims, 10 Drawing Sheets

(56) References Cited

U.S. PATENT DOCUMENTS

| | | | | |
|---|---|---|---|---|
| 7,921,761 | B1 * | 4/2011 | Quinn | 89/204 |
| 8,047,118 | B1 * | 11/2011 | Teetzel et al. | 89/41.17 |
| 8,100,044 | B1 * | 1/2012 | Teetzel et al. | 89/41.17 |
| 8,297,173 | B1 * | 10/2012 | Teetzel et al. | 89/41.17 |
| 2002/0129535 | A1 * | 9/2002 | Osborn, II | 42/122 |
| 2002/0180866 | A1 * | 12/2002 | Monroe | 348/153 |
| 2003/0010190 | A1 * | 1/2003 | Sammut et al. | 89/41.17 |
| 2005/0066808 | A1 * | 3/2005 | Hawkes et al. | 89/41.05 |
| 2011/0120438 | A1 * | 5/2011 | Samuels et al. | 124/87 |
| 2011/0168777 | A1 * | 7/2011 | Bay | 235/414 |
| 2012/0097741 | A1 * | 4/2012 | Karcher | 235/404 |
| 2013/0133510 | A1 * | 5/2013 | Piazza et al. | 89/41.05 |
| 2014/0110482 | A1 * | 4/2014 | Bay | 235/404 |

* cited by examiner

WEAPON VIDEO DISPLAY SYSTEM EMPLOYING SMARTPHONE OR OTHER PORTABLE COMPUTING DEVICE

SUMMARY

The present disclosure relates to a weapon video display system including mechanical hardware for attaching a portable electronic device such as a smartphone including the Motorola Android smartphones, Apple iPhone smartphones, and so forth, to a weapon. Although the present development will be described herein primarily by way of reference to the preferred embodiment wherein the portable electronic device is a smartphone, it will be recognized that the present development could likewise employ similar hand held computing devices, including tablets, personal digital assistants (PDA's), and the like.

The system also includes one or more software applications running on the smartphone/portable electronic device which would allow the operator to access and display multiple modes including system status, squad member status, squad member positioning, range to target based on input from an associated optical range finder, ballistic solution presented via a so-called moving reticle or displaced reticule on the smartphone/portable electronic device display, round counter, air quality sensing alarm, video recording and communications. In addition, a dedicated fire control system may be provided for providing a ballistics solution and providing a viewable displaced or moving reticle display.

A weapon mounted handgrip provides an input functionality to the smartphone/portable electronic device and allows the operator to navigate through various menus and select functions while also maintaining control of the weapon.

The system may employ a powered rail system including an accessory mount interface such as a Picatinny type mounting rail structure (e.g., as per standard MIL-STD-1913) of the type commonly employed with a military or tactical firearm for attaching accessories. The rail system may be of the type having integral circuit components, for example, as described in commonly owned U.S. Pat. No. 8,091,265, which is incorporated herein by reference in its entirety.

In one aspect, a video display system for a weapon includes an optical range finder removably attachable to the weapon for calculating a distance to a selected target. The optical range finder includes an optical emitter for sending an optical signal to a target and an optical detector for detecting the signal reflected from the target. A fire control system is removably attachable to the weapon and associated with the optical range finder. The fire control system includes a ballistics computer for calculating a ballistics solution based on the distance to the target. A portable electronic device associated with the fire control system has a display screen and is removably attachable to the weapon. The portable electronic device includes a processor and a memory storing program instructions, the program instructions configured to display the ballistics solution in human viewable form on the display screen. In another aspect, a weapon video display includes a housing including a first housing shell pivotally attached to a second housing shell, the second housing shell removably receiving a portable electronic device. A fastener attached to the housing is adapted to removably attach to a weapon rail interface and the first housing shell extends parallel to a first axis aligned with a barrel of a weapon when the housing is attached to the weapon rail interface. The second shell is pivotable between a first, closed position and a second, open position, about a second axis orthogonal to the first axis.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
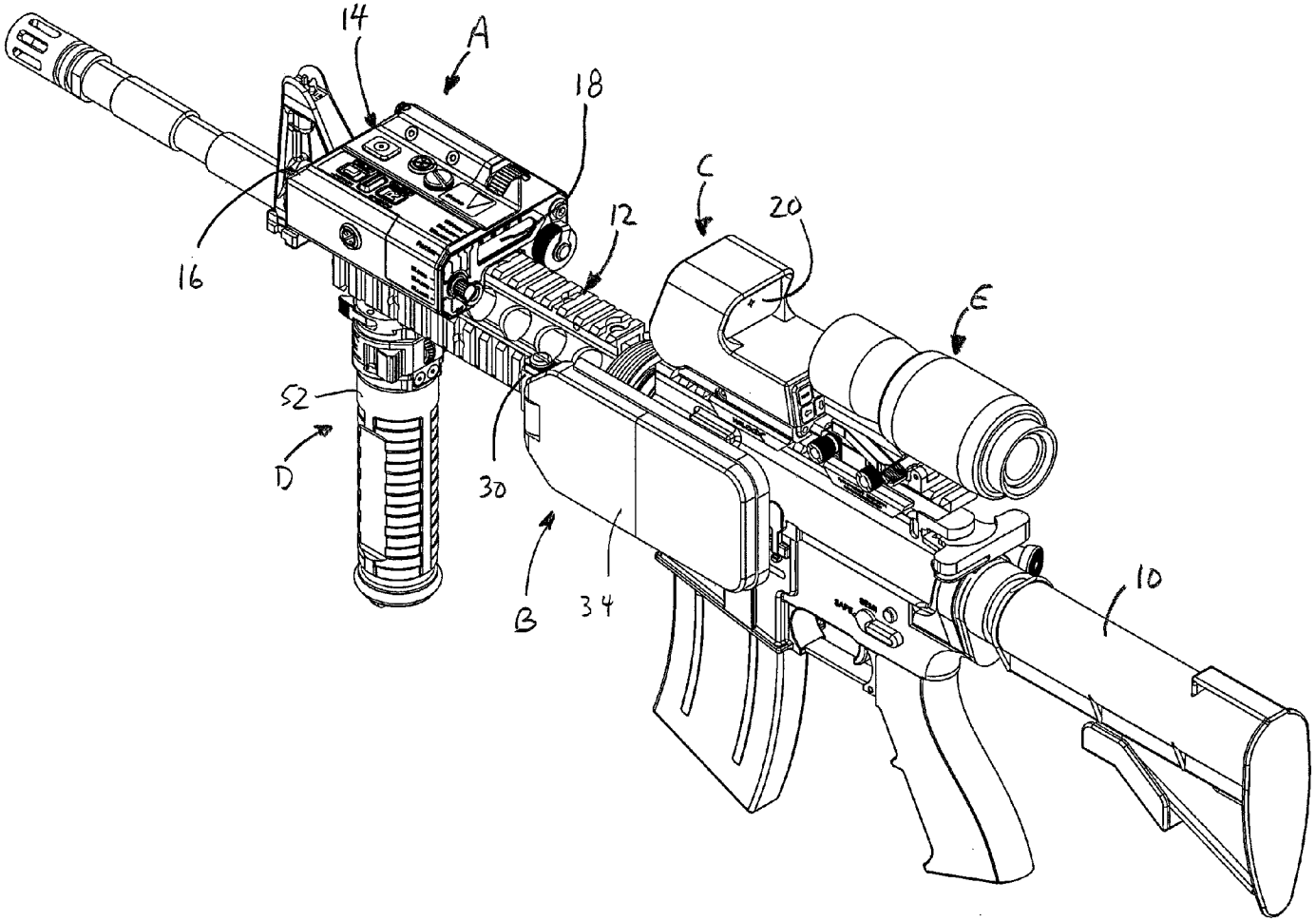
FIG. 1 is an isometric view of a firearm employing an exemplary weapon video display system herein, wherein the smartphone is in a closed or non-deployed position.
Figure 2:
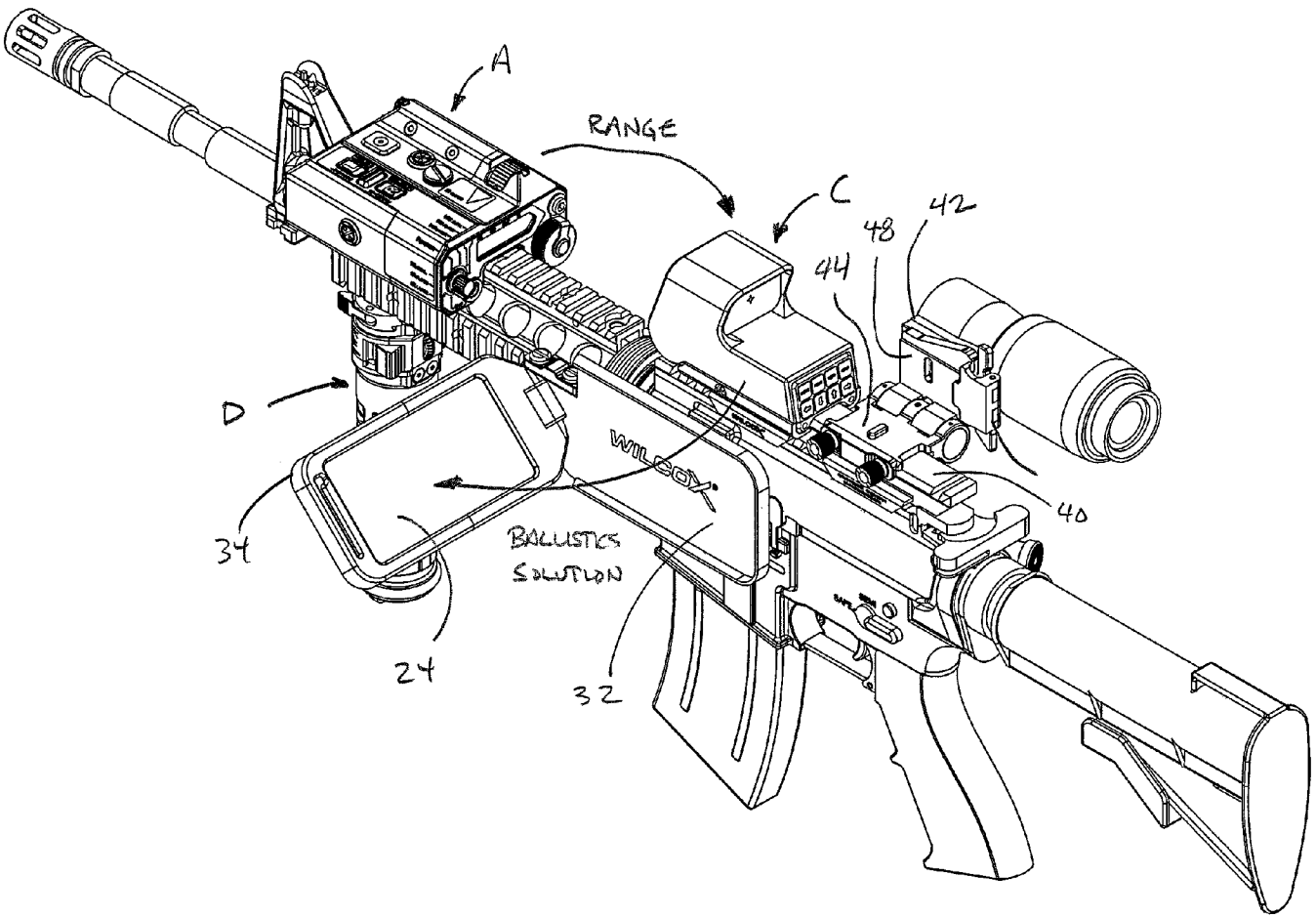
FIG. 2 is an isometric view of the system appearing in FIG. 1, wherein the smartphone is in a first deployed position.
Figure 3:
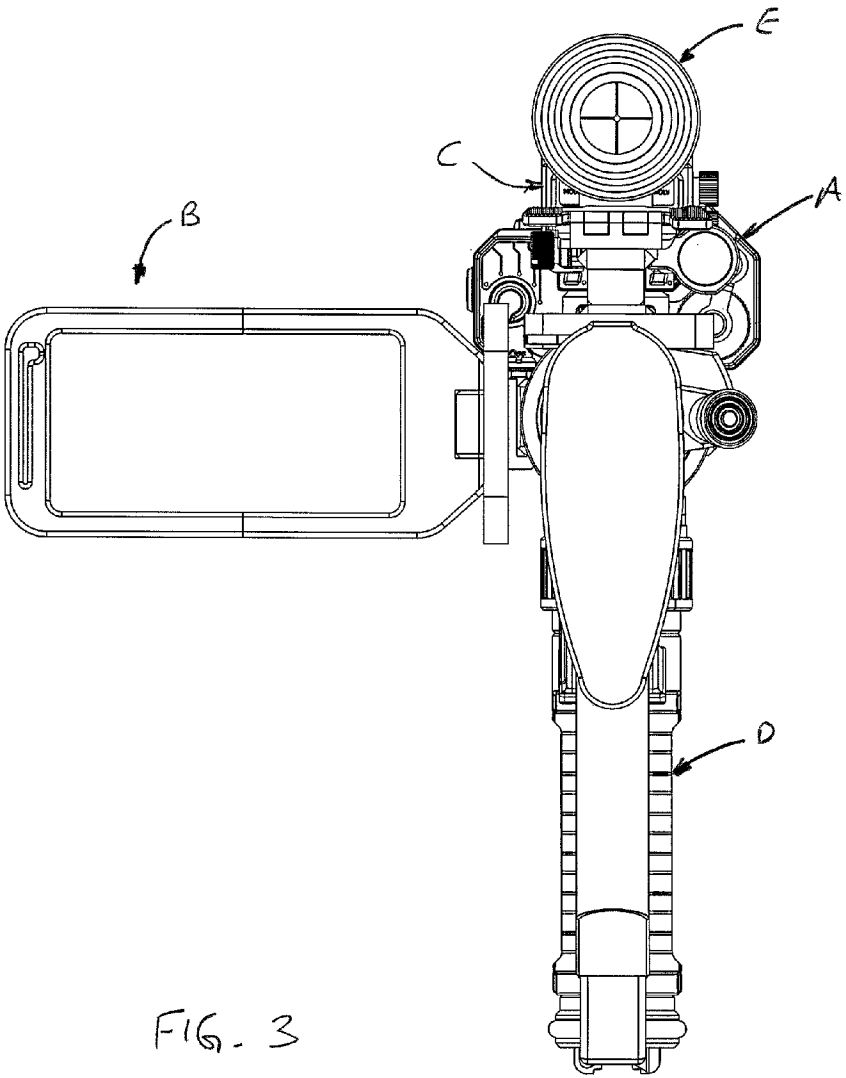
FIGS. 3-5 are rear, isometric, and exploded views, respectively, of the system appearing in FIG. 1, wherein the smartphone is in a second deployed position.
Figure 4:
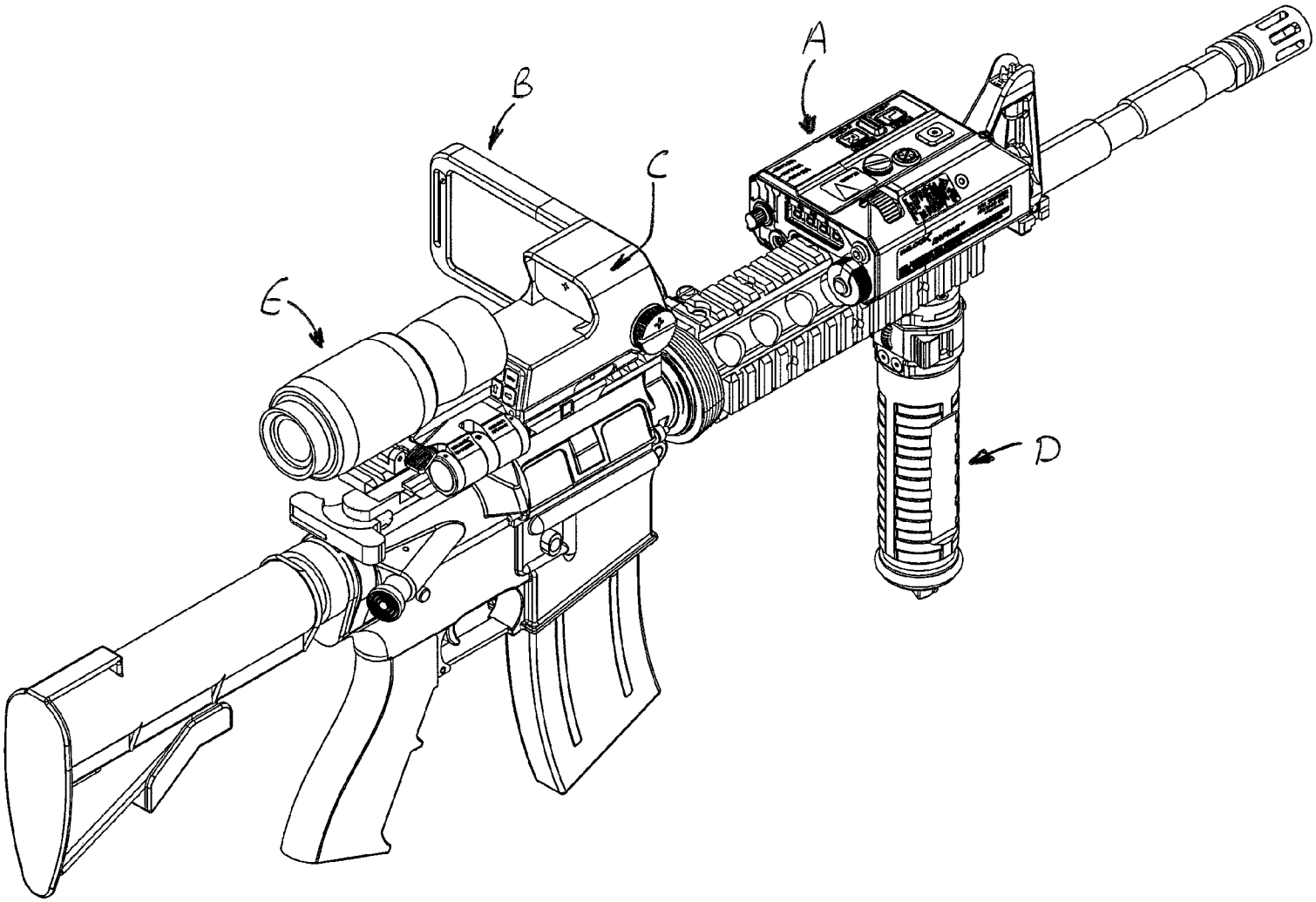
Figure 5:
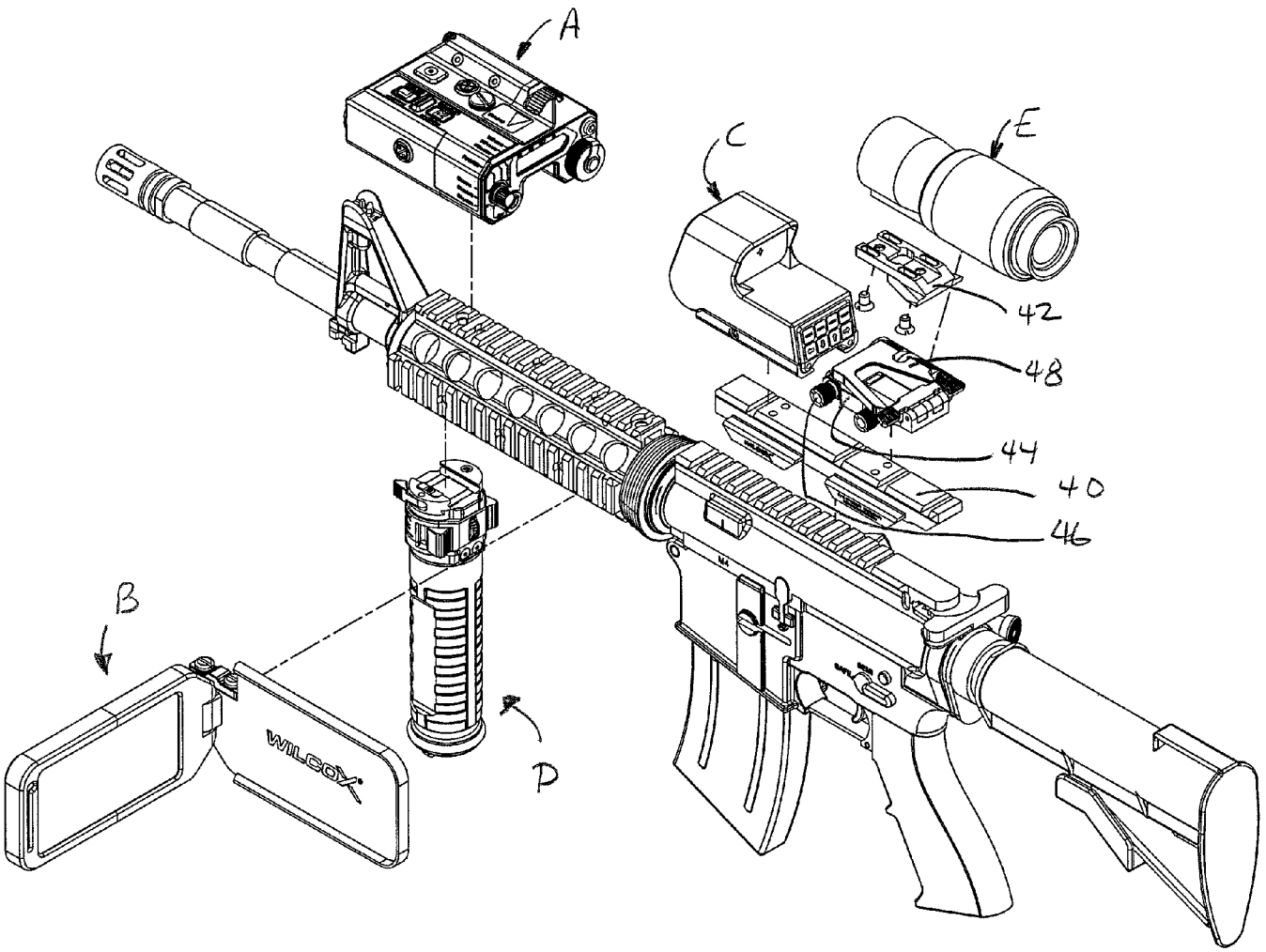

Referring now to the drawing figures, wherein like reference numerals and characters denote like components throughout the several views, there appears a firearm 10 which contains an accessory mounting rail system 12, which may include a Picatinny mounting rail structure (e.g., as per standard MIL-STD-1913). The mounting rail system 12 is of a type that includes an integral or embedded circuit having contacts and electrical conductors that provides for the transmission of power, data, and/or communications signals between electronic devices attached to the rails system 12. Although a firearm is depicted, it will be recognized that the system may be employed for any man-portable weapon platform, including grenade launchers, mortars, and so forth.

The weapon video display system herein includes a laser range finder A, which includes an optical emitter and an optical receiver. The optical range finder A includes a base portion having a rail clamp for securing the range finder A to the rail system 12. The optical transmitter includes an optical source 14, such as a laser and preferably an infrared (IR) laser source, and most preferably two or more laser sources of different wavelengths, such as a visible laser source and an IR laser source, and an optical receiver 16. In operation, the distance to a target is determined by measuring the time interval between the emission of an optical signal by the transmitter to the target and detection of the reflected signal by the receiver. A display 18 on the range finder A may be provided to display the distance to the target.

Range information is transmitted to a fire control system C, which includes a ballistics calculation processor or function, which may be implemented in hardware, software, firmware, or the like, and which calculates a ballistics solution based on the range information and the particular weapon 10 to allow the user to aim the weapon in a manner which compensates for the effect of gravity and other ballistics or aiming factors.

Figure 12:
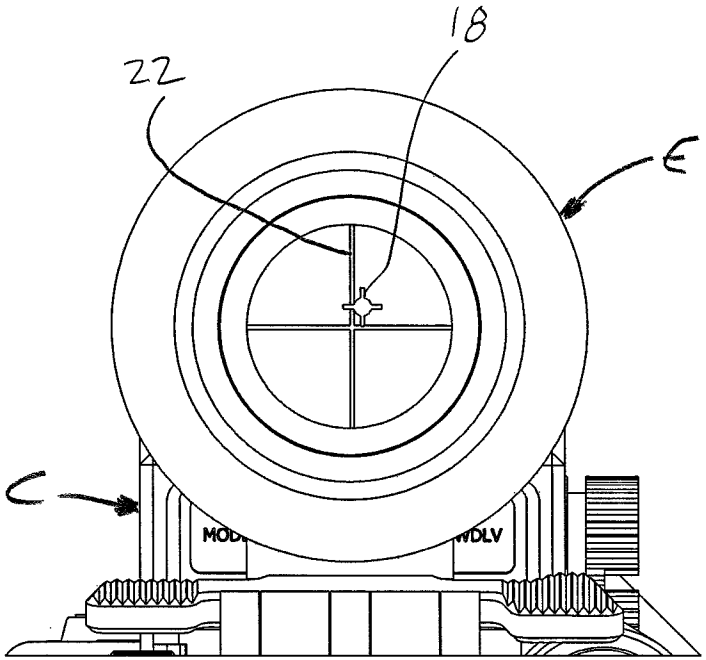
FIGS. 12 and 13 are enlarged rear views of the scope showing a magnified view of the displaced reticle display in the unaligned and aligned positions, respectively.
Figure 13:
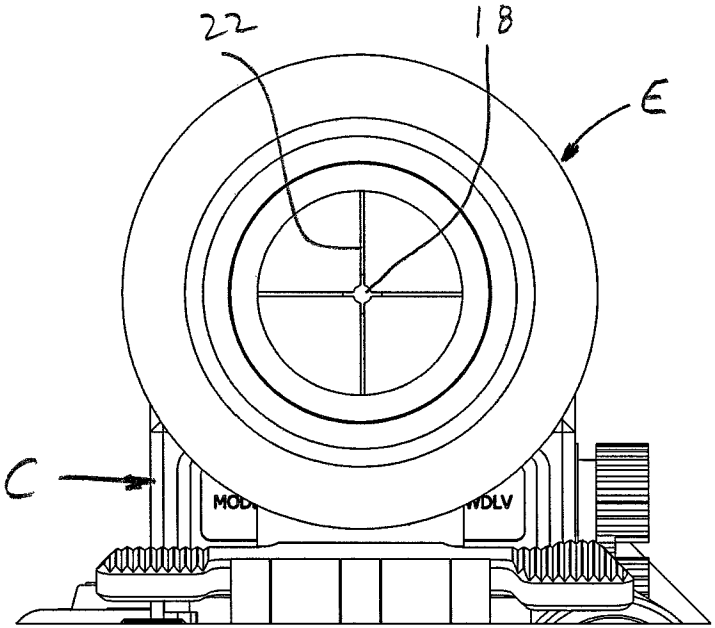
Figure 14:
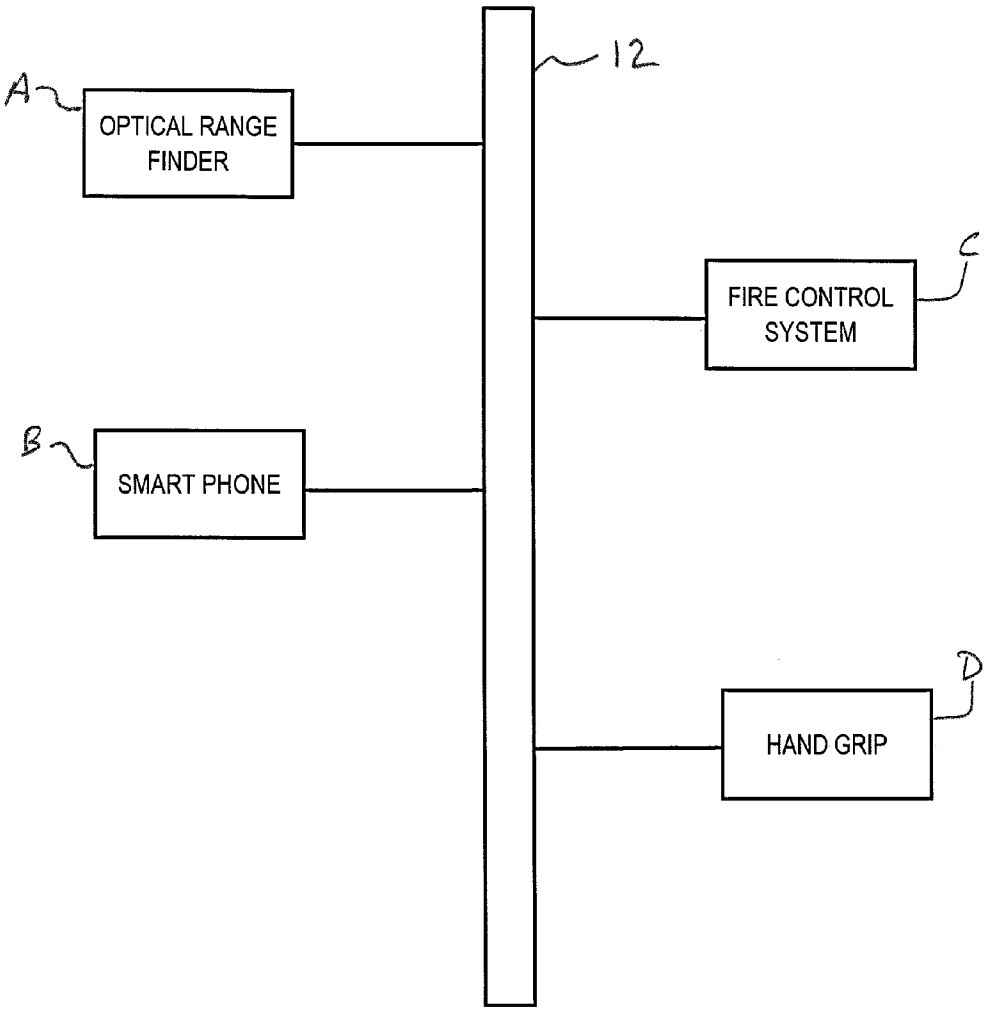
FIG. 14 a functional block diagram illustrating the smartphone weapon video display system of FIG. 1.

The ballistics solution is graphically depicted via a moving reticle 18 (see FIG. 12) on a display screen 20 (e.g., an LCD screen) or see through display of the fire control system C. Movement of the firearm 10 may be tracked using a three-axis accelerometer within the fire control system C such that movement of the firearm will cause the displaced reticle 18 to move on the screen 20. When the reticle 18 is aligned with on-screen cross hairs or other on-screen indicia 22, the weapon 10 will be aimed to accurately hit the target when fired.

The ballistics solution from the fire control system C can also be sent to an associated portable electronic device B, which is a smartphone in the exemplary preferred embodiment illustrated. The smartphone B may include a displaced reticle application, wherein a similar moving reticle display is shown on the display screen 24 of the smartphone B. For example, an accelerometer in the smartphone may be used control the position of the moving reticle on the smartphone display screen 24 based on the orientation of the weapon 10.

The smartphone B may be received in a housing which includes a rail clamp or grabber 30, a first housing shell 32, and a second housing shell 34. The first housing shell 32 extends parallel to the firearm and receives the smartphone B when the smartphone is not in use. The smartphone B is carried in the shell 34, which is pivotally attached to the shell 32. Preferably, the second housing shell is pivotable about a first vertical axis allowing the smartphone to be pivoted between a viewable or open position and a nonviewable or closed position to move the phone out of the way and protect the smartphone when not in use.

In an especially preferred embodiment, the second shell 34 is also pivotable with respect to the first shell 32 about a horizontal axis extending transversely with respect to the weapon 10, thereby allowing the user to adjust the angle of the smartphone display screen 24 to a desired viewing angle when the second housing is in the open position. The housing shell may be adapted to fit an existing make and model of smartphone. The housing may include an electrical connector for electronically coupling charging and/or data contacts on the smartphone to the power and/or data circuit conductors on the rail system 12.

In addition to the ballistic solution displayed on the screen 24 via displaced reticle application detailed above, the smartphone may also include other applications (or other functions or modes within an application). For example, an application may be provided which receives signals from the other components, system status, squad member status, squad member positioning, range to target based on input from the laser range finder, round counter, and so forth, as will be described in greater detail below. In addition, the smartphone B can also be used in connection with standard smartphone functions, such as voice, text, and data communication, and applications.

An optional optical scope E may be mounted behind the fire control system C in optical alignment with the fire control system displaced reticle display to provide the operator with an enlarged (e.g., 3× enlargement) view of the fire control system display screen 20. In the illustrated embodiment, the scope E is secured to a mount, which includes a base 42 having a rail grabber 44 and a pivoting member 46 carrying the scope E, which allows the user to flip the scope in and out of optical alignment with the fire control system E.

In the depicted preferred embodiment, the scope E and the fire control system C are secured to an auxiliary rail member 40 which, in turn, is secured to the rail system 12. In this manner, the fire control system C and the optical scope E may be removed as a unit. The auxiliary rail member 40 may include a high precision rail clamp which allows it to be removed and replaced without the need to re-boresight the fire control system C and scope E to the weapon 10. The auxiliary clamp may employ, for example, a three-point clamp of the type described in commonly owned U.S. Pat. No. 7,685,759, the entire contents of which are incorporated herein by reference.

Figure 8:
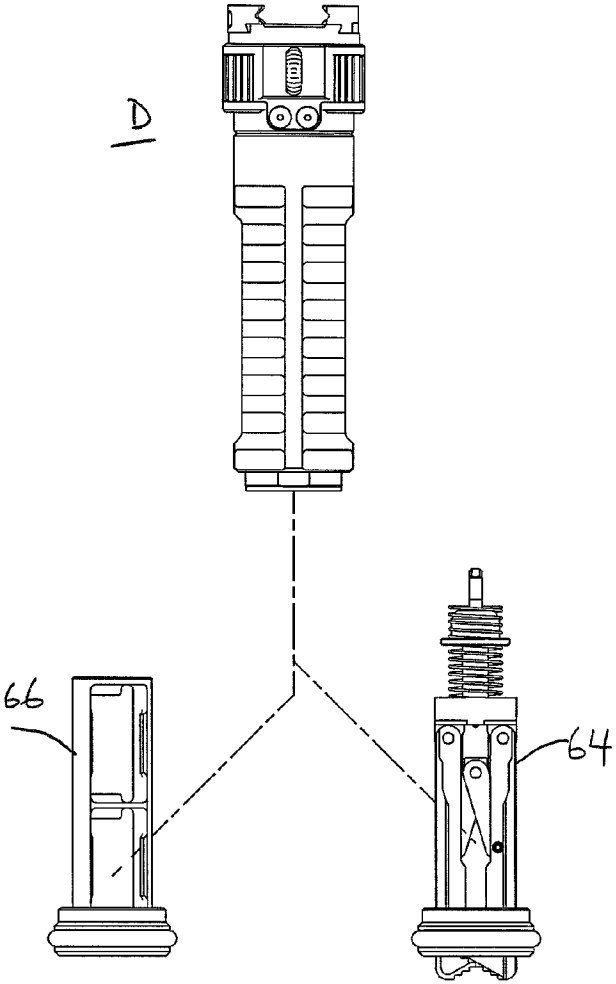
FIGS. 6-8 are isometric, elevational, and partially exploded views of an exemplary handgrip embodiment.

A handgrip unit D is attached to the rail system 12 and extends substantially vertically downward from a forearm portion of the weapon 10. The handgrip unit D includes a rail grabber 50 at its upper end and a generally hollow handgrip housing portion 52. In certain embodiments, the handgrip housing 52 may receive a retractable bipod assembly 64, which may be, for example, as described in commonly owned U.S. Pat. Nos. 7,841,120 and 7,712,241, each of which is incorporated herein by reference in its entirety. In alternative embodiments, the handgrip housing may house an auxiliary rechargeable battery or battery pack 56 for the smartphone B, wherein the auxiliary battery 66 is electrically coupled to the smartphone via the circuit of the rail system 12. In alternative embodiments, the auxiliary battery may also be used to power other weapon mounted accessories, including the ranger finder and the fire control system. In still further embodiments, the bipod assembly 64 and the auxiliary battery/battery pack 66 are removable and interchangeable modules, as shown in FIGS. 8 and 11.

Figure 7:
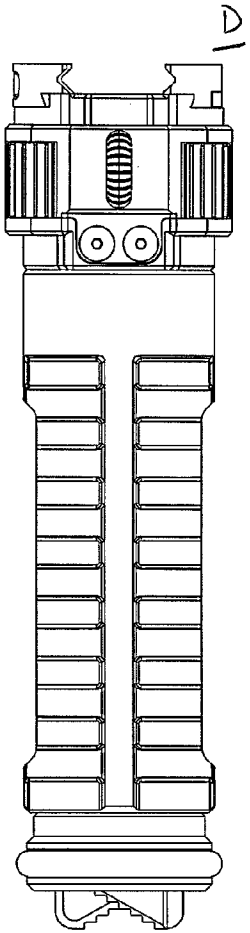
Figure 6:
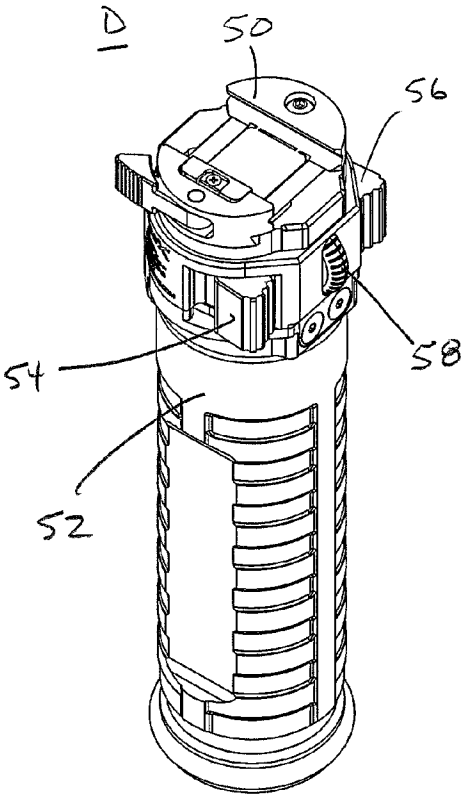

The handgrip D additionally includes input controls for navigating screens and menus of the software applications running on the smartphone B. As best seen in FIGS. 6-8, there is shown an exemplary handgrip apparatus D having left and right buttons 54 and 56 and a scroll wheel 58, e.g., of a type employing a optical, opto-electronic, or electromechanical system, for navigating a user interface on the smartphone B, controlling the position of a cursor or other on-screen pointer, navigating a menu hierarchy, etc. The buttons and scroll wheel are located adjacent to the user's thumb when the handgrip is grasped by the user to allow the user to navigate the smartphone application without the need to remove the user's hand from the grip, e.g., as an alternative to a buttons, touch screen, or other input means on the smartphone. The scroll wheel 68 may also be a manually depressible button, e.g., for selecting an on-screen object on the smartphone display.

Figure 11:
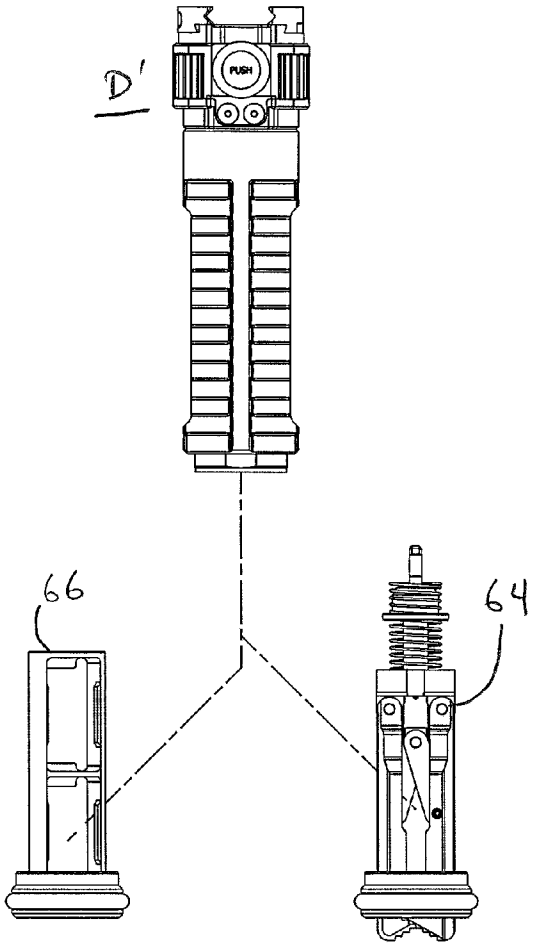
FIGS. 9-11 are isometric, elevational, and partially exploded views of an alternative handgrip embodiment.
Figure 10:
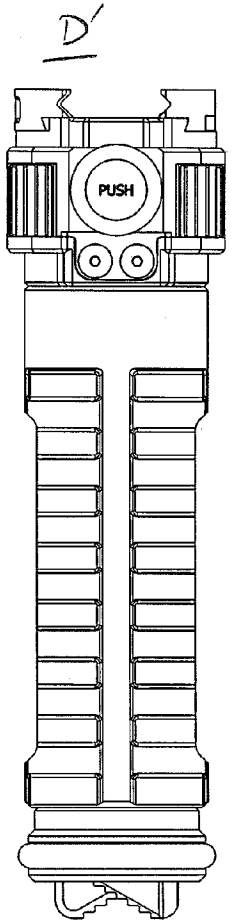
Figure 9:
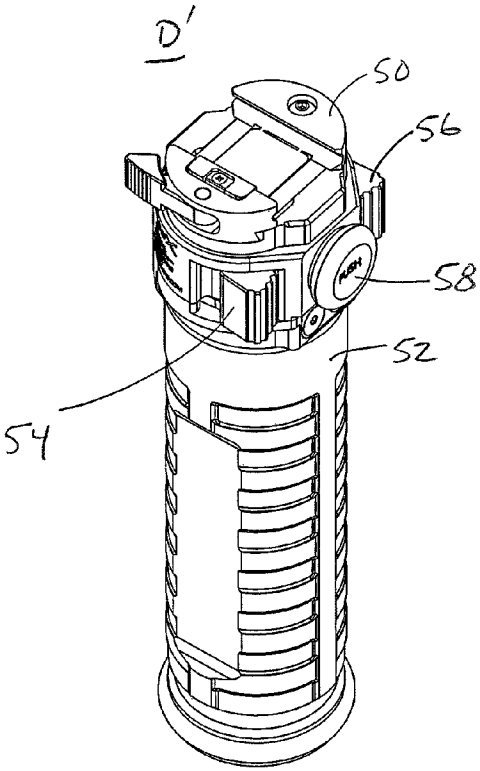

FIGS. 9-11 depict an alternative handgrip apparatus D', wherein the smartphone on-screen pointer and navigation are controlled by left and right buttons 54 and 56 for controlling a pointer position or otherwise navigating through on-screen objects, menus, etc., and a push button 60 for selecting a desired object, menu selection, etc. Other on-screen pointer and navigation control hardware may also be employed in place of the depicted buttons and scroll wheel, such as a track ball, track stick, joystick, and so forth.

Figure 15:
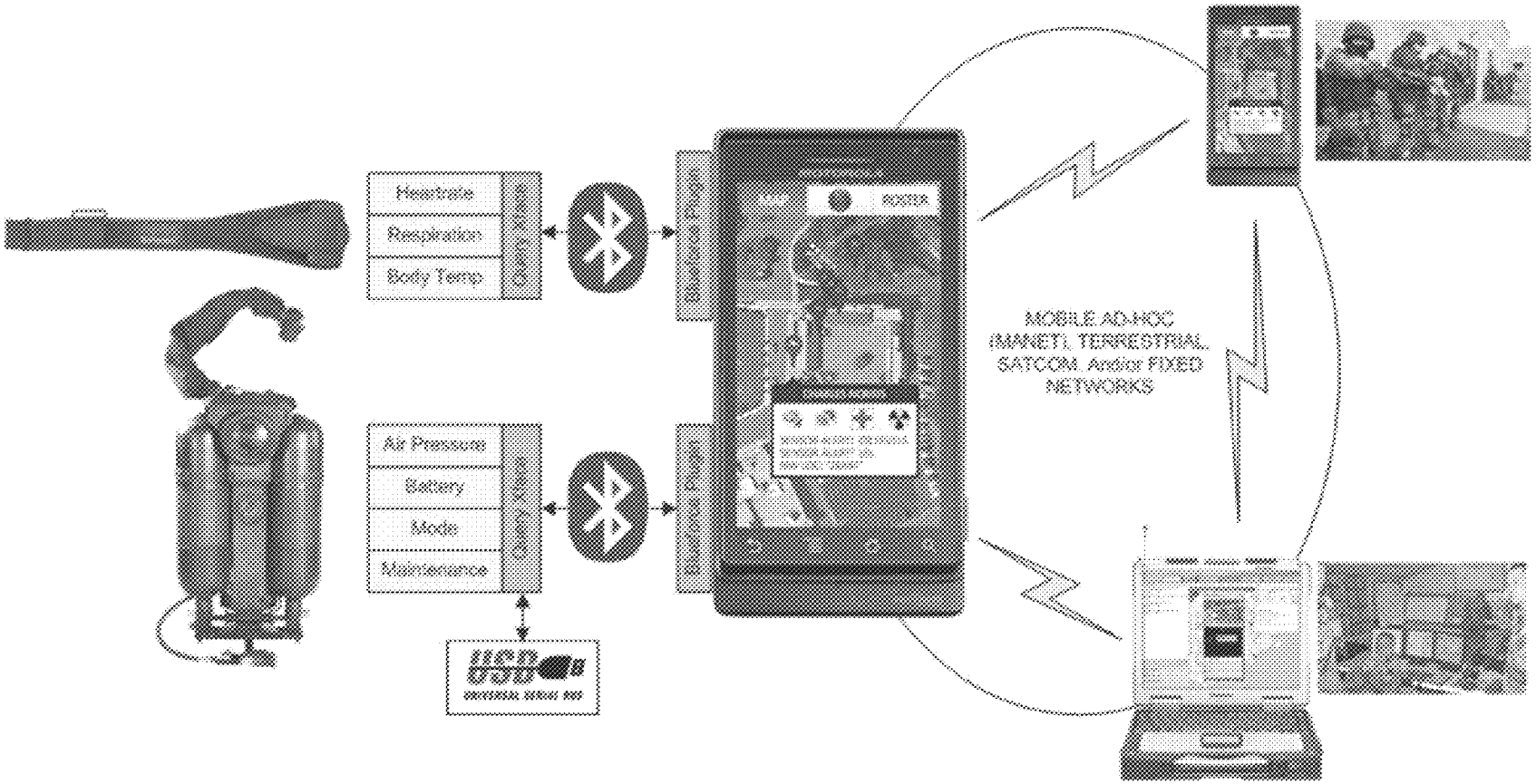
FIG. 15 is a schematic diagram illustrating the smartphone having an exemplary mapping and tracking application.

Referring now to FIG. 15, there appears an exemplary mapping and tracking system which may be used for displaying so called blue (friendly) force location and tracking (although it will be recognized that "red force" positional information can also be displayed). Position information, e.g., satellite positioning and other information may be transmitted via a mobile ad-hoc (MANET), terrestrial, SATCOM, and/or fixed networks. The mapping and tracking application may also be used for user positioning and navigation, e.g., using a global positioning system receiver in the smartphone B.

Optionally, application software on the smartphone B may be used for receiving a signal representative of a physiological condition of the user, such as heart rate respiration rate, and/or temperature from an associated heart rate monitor, respiration rate monitor and thermometer/temperature probe, respectively, and which signal may be sent to the smartphone B wirelessly via a suitable wireless protocol, such as Bluetooth, WiFi, ZigBee, ANT/ANT+, IEEE 802.15.4, Z-Wave, etc.

In certain embodiments, smartphone application software may be provided to display the status of a breathing system worn by the user, such as the PATRIOT® system available from Wilcox Industries Corp. of Newington, N.H. and described commonly owned U.S. Pat. No. 7,647,927, which is incorporated here by reference in its entirety. With reference to FIG. 15, such status indications may be air pressure, battery life, breathing mode (e.g., canister or filtered air) and maintenance status, which may be transmitted to the smartphone via a wireless communication protocol as set forth above or via a cabled connection.

Other information that may be displayed on the screen 24 of the smartphone B includes system status, including without limitation, self-test status of the range finder, self-test status of the fire control system, connected devices, network signal strength, smartphone battery life, auxiliary battery life, and so forth.

A round counter application (e.g., which may use the accelerometer in the smartphone B and the recoil of the weapon 10 to track the number of rounds which are fired from the weapon 10 or which are fired over a particular period of time) may also be provided. The round counter application may advantageously track rounds for a number of reasons, including without limitation training or certification purposes, assessing the maintenance schedule and lifespan of the firearm, and so forth. In certain embodiments, the round counter application logs information relating whether and how many times a weapon has been fired. In other embodiments, e.g., law enforcement and/or military situations, round information may also be logged together with clock and/or GPS data to also provide a record of when and/or where such rounds were fired.

The invention has been described with reference to the preferred embodiments. Modifications and alterations will occur to others upon a reading and understanding of the preceding disclosure herein, whereby it is to be distinctly understood that the foregoing descriptive matter is to be interpreted merely as illustrative of the invention and not as a limitation.

What is claimed is:

1. A video display system for a weapon, comprising:

an optical range finder removably attachable to the weapon for calculating a distance to a selected target, said optical range finder including an optical emitter for sending an optical signal to a target and an optical detector for detecting the signal reflected from the target;

a fire control system removably attachable to the weapon associated with the optical range finder, said fire control system including a ballistics computer for calculating a ballistics solution based on the distance to the target, said ballistics solution representative of a ballistic trajectory path of a projectile to be fired by the weapon; and a portable electronic device associated with the fire control system and having a display screen, the portable electronic device removably attachable to the weapon, the portable electronic device including and a processor and a memory storing program instructions, the program instructions configured to display the ballistics solution in human viewable form on the display screen.

2. The video display system of claim 1, the portable electronic device including:

an accelerometer for sensing an angular orientation of the portable electronic device; and the program instructions configured to display a video representation of a displaced reticle on the display screen, wherein the displaced reticle is movable responsive to movement of the weapon.

3. The video display system of claim 2, further comprising:

the displaced reticle including a movable element and a fixed element, such that a barrel of the weapon will be aligned with a trajectory angle that will cause the projectile fired by the weapon to reach the target when the movable element is aligned with the fixed element on the display screen.

4. The video display system of claim 3, wherein the portable electronic device is selected from a smartphone, a mobile telephone, and a personal digital assistant (PDA), and a hand-held computer.

5. The video display system of claim 1, further comprising:

a first fastener adapted to removably attach the optical range finder to a weapon rail interface;

a second fastener adapted to removably attach the fire control system to the weapon rail interface; and a third fastener adapted to removably attach the portable electronic device to the weapon rail interface.

6. The video display system of claim 1, further comprising:

a housing receiving the portable electronic device, the housing pivotable between an open, viewable position and a closed position.

7. The video display system of claim 1, further comprising:

a reticle on the fire control system.

8. The video display system of claim 7, further comprising:

an optical scope removably attachable to the weapon in optical alignment with the reticle.

9. The video display system of claim 8, further comprising:

an auxiliary rail member removably attachable to a weapon rail interface;

said fire control system and said optical scope removably attached to the auxiliary rail member, whereby the fire control system and said optical scope may be removed from and attached to the weapon as a unit while maintaining a fixed position relative to each other.

10. The video display system of claim 1, further comprising:

a handgrip removably attachable to the weapon; and one or more switches on the handgrip and coupled to the portable electronic device, said one or more switches for generating an input device signal to the processor.

11. The video display system of claim 1, wherein the portable electronic device includes a global positioning system receiver.

12. The video display system of claim 1, further comprising:

said program instructions further configured to receive position information representative of a position of one or more entities and display a graphic representation of the position information on the display.

13. The video display system of claim 12, wherein said one or more entities include friendly forces, enemy forces, or both.

14. The video display system of claim 12, further comprising:

the portable electronic device including a global positioning system receiver for determining a position of the user; and said program instructions configured to display a graphic representation of the position of the user relative to said one or more entities.

15. The video display system of claim 1, further comprising:

one or more physiological sensors worn by a user; and said program instructions configured to display data representative of a physiological condition of the user responsive to said one or more physiological sensors.

16. The video display system of claim 1, further comprising:

said portable electronic device having an sensor sensing movement of the weapon resulting from firing the weapon; and the program instructions further including instructions for logging in the memory any one or more of (i) a count of the number of times the weapon has been fired; (ii) position information associated with each sensed movement of the weapon resulting from firing the weapon; and (iii) date and time information associated with each sensed movement of the weapon resulting from firing the weapon.

17. The video display system of claim 1, further comprising:

a housing including a first housing shell pivotally attached to a second housing shell, the second housing shell removably receiving the portable electronic device;

a fastener attached to the housing and adapted to removably attach to a weapon rail interface;

the first housing shell extending parallel to a first axis aligned with a barrel of a weapon when the housing is attached to the weapon rail interface; and the second shell pivotable between a first, closed position and a second, open position, about a second axis orthogonal to the first axis.

18. The video display system of claim 17, further comprising:

the second shell rotatable about a third axis extending generally transversely with respect to the first axis, the first, second, and third axes being mutually orthogonal.

19. The video display system of claim 17, wherein the weapon rail interface is a Picatinny rail interface.

20. The video display system of claim 17, wherein the weapon rail interface is a powered rail interface and further comprising:

electrical contacts on the housing for electrically coupling one or both of charging contacts on the portable electronic device and data contacts on the portable electronic device to electrical conductors on the powered rail interface.

* * * * *